US011801916B2

(12) United States Patent
Hovde et al.

(10) Patent No.: US 11,801,916 B2
(45) Date of Patent: Oct. 31, 2023

(54) SUB SEA MOORING CHAIN CONNECTOR AND TENSIONER

(71) Applicant: APL Norway AS, Kolbjørnsvik (NO)

(72) Inventors: Geir Olav Hovde, Kolbjørnsvik (NO); Sven Atle Svensen, Kolbjørnsvik (NO)

(73) Assignee: APL NORWAY AS, Kolbjørnsvik (NO)

( * ) Notice: Subject to any disclaimer, the term of this patent is extended or adjusted under 35 U.S.C. 154(b) by 422 days.

(21) Appl. No.: 17/287,059

(22) PCT Filed: Oct. 7, 2019

(86) PCT No.: PCT/NO2019/050212

§ 371 (c)(1),
(2) Date: Apr. 20, 2021

(87) PCT Pub. No.: WO2020/085913

PCT Pub. Date: Apr. 30, 2020

(65) Prior Publication Data

US 2021/0380203 A1 Dec. 9, 2021

(30) Foreign Application Priority Data

Oct. 24, 2018 (NO) ..... 20181371

(51) Int. Cl.
*B63B 21/04* (2006.01)
*B63B 21/00* (2006.01)
(Continued)

(52) U.S. Cl.
CPC ..... *B63B 21/04* (2013.01); *B63B 21/00* (2013.01); *B63B 21/08* (2013.01); *B63B 21/10* (2013.01);
(Continued)

(58) Field of Classification Search
CPC ..... B63B 21/00; B63B 21/04; B63B 21/08; B63B 21/10; B63B 21/16; B63B 21/20; B63B 21/50
(Continued)

(56) References Cited

U.S. PATENT DOCUMENTS 5,845,893 A 12/1998 Groves
6,983,714 B2 1/2006 Dove et al.
(Continued)

FOREIGN PATENT DOCUMENTS

KR 2018-0076488 A 7/2018
NO 20130615 A1 11/2014
(Continued)

OTHER PUBLICATIONS

International Bureau, International Search Report in International Application No. PCT/NO2019/050212, dated Jan. 6, 2020.
(Continued)

*Primary Examiner* — Lars A Olson
(74) *Attorney, Agent, or Firm* — Leydig, Voit & Mayer, Ltd.

(57) ABSTRACT

A mooring line length adjusting device and methods is disclosed. The connecting device is arranged for connecting a lower section and an upper section of a mooring line to respective ends of the device and for adjusting a total length of said mooring line from a previous mooring line length to a new mooring line length. The upper end of the mooring line is connected to a floating unit. At least said lower section comprises a chain segment at its top end connected to the device. The device comprises a locking arrangement to lock said chain segment to the connecting device.

14 Claims, 15 Drawing Sheets

(51) Int. Cl.

| | |
|---|---|
| ***B63B 21/08*** | (2006.01) |
| ***B63B 21/10*** | (2006.01) |
| ***B63B 21/16*** | (2006.01) |
| ***B63B 21/20*** | (2006.01) |
| ***B63B 21/50*** | (2006.01) |

(52) U.S. Cl.
CPC ..... *B63B 21/16* (2013.01); *B63B 21/20* (2013.01); *B63B 21/50* (2013.01)

(58) Field of Classification Search
USPC ..... 114/230.22, 230.24
See application file for complete search history.

(56) References Cited

U.S. PATENT DOCUMENTS

| | | | |
|---|---|---|---|
| 7,240,633 | B2 | 7/2007 | Barlow |
| 7,926,436 | B2 | 4/2011 | Boatman et al. |
| 9,003,994 | B2 | 4/2015 | Leverette et al. |
| 11,008,070 | B2 * | 5/2021 | Taylor ..... B63B 21/50 |
| 2001/0029878 | A1 | 10/2001 | Seaman et al. |
| 2002/0189522 | A1 | 12/2002 | Dove et al. |
| 2006/0254494 | A1 | 11/2006 | Wingate |
| 2012/0160146 | A1 | 6/2012 | Miller et al. |
| 2014/0339485 | A1 | 11/2014 | Busson |
| 2017/0349243 | A1 | 12/2017 | Lisland |

FOREIGN PATENT DOCUMENTS

| | | | |
|---|---|---|---|
| NO | 20160964 | A1 | 12/2017 |
| WO | WO 89/03786 | A1 | 5/1989 |
| WO | WO 2013/004749 | A1 | 1/2013 |
| WO | WO 2013/043049 | A1 | 3/2013 |
| WO | WO 2014/178721 | A2 | 11/2014 |
| WO | WO 2015/150770 | A1 | 10/2015 |
| WO | WO 2016/068717 | A1 | 5/2016 |
| WO | WO 2016/118006 | A1 | 7/2016 |
| WO | WO 2018/025018 | A1 | 2/2018 |
| WO | WO 2019/054878 | A1 | 3/2019 |

OTHER PUBLICATIONS

International Bureau, Written Opinion of the International Searching Authority in International Application No. PCT/NO2019/050212, dated Jan. 6, 2020.

International Bureau, International Preliminary Report on Patentability in International Application No. PCT/NO2019/050212, dated Dec. 13, 2020.

* cited by examiner

SUB SEA MOORING CHAIN CONNECTOR AND TENSIONER

CROSS-REFERENCE TO RELATED APPLICATIONS

This patent application is the U.S. National Stage of International Patent Application No. PCT/NO2019/050212, filed Oct. 7, 2019, which claims the benefit of Norwegian Patent Application No. 20181371, filed Oct. 24, 2018, which are each incorporated by reference.

TECHNICAL FIELD

The present invention relates to offshore mooring systems. More specifically it relates to a subsea line connector and tension adjusting device for a mooring line.

BACKGROUND

All mooring systems will require line length adjustment at some point in time, either as part of the initial installation to obtain the target line length and target pretension or at a later stage to compensate for line length variation over time. Examples of root causes for line length variations over time may be corrosion or wear of chain sections or elongation of synthetic fiber ropes such as polyester ropes. Polyester ropes are especially used in mooring systems for deep to ultradeep waters, because of its beneficial weight and stiffness properties. However, one drawback with polyester ropes is that it creeps over time when subject to continuous loading. It also creeps when it experiences loads higher than it has seen earlier. Part of this creep can be mitigated by stretching the rope to a high tension during the offshore installation campaign, but for practical reasons, such as the capacity of the installation vessel and risk related to working with high loads, there is an upper limit on how much tension that can be applied. Adjustment of the length of mooring lines, especially if comprising polyester rope sections, may thus be required during the design life of the mooring system.

Further, during initial installation all mooring lines will have a final connection point, which very often is the connection towards the floating unit but can also be at any other convenient point along the mooring line.

The force required for the final connection will be in the order of the pretension load, which is the static tension in the mooring line after the offshore installation has been completed. The same force will also be required for any future re-tensioning operations as described above. Special considerations with respect to method and devices for the final connection of the mooring lines and potential future re-tensioning operations will thus be required.

Related prior art is disclosed patent documents WO8903786A1, U.S. Pat. Nos. 5,845,893, 6,983,714B2, US20010029878A1, U.S. Pat. Nos. 7,240,633B2, 7,926,436B2, US2014339485A1, US20120160146A1, WO2013004749A1, WO2013043049A1, NO20130615A1, U.S. Pat. No. 9,003,994B2, WO2015150770A1, WO2016068717A1, WO2016118006A1 and NO20160964A1.

An object of the present invention is to overcome shortcomings of the disclosed prior art and to provide an alternative to the prior art. To achieve these objectives a device according to claim 1 is provided.

SHORT SUMMARY OF THE INVENTION

The present invention is a mooring line connection and a tension adjusting device. Main goal of this invention is to facilitate and ease line length adjustments of mooring lines—both shortening and lengthening, to stay within the design envelope of the mooring arrangement for the moored unit.

The connecting device is arranged for connecting a lower section and an upper section of a mooring line to respective ends of the device and for adjusting a total length of said mooring line from a previous mooring line length to a new mooring line length. The upper end of the mooring line is connected to a floating unit. At least said lower section comprises a chain segment at its top end connected to the device. The device comprises a locking arrangement to lock said chain segment to the connecting device. The locking arrangement—when locking said chain segment to the device—dividing said chain segment into a tensioned portion and a loose portion. Temporary pulling means is connected to the end of the loose portion adapted for pulling the said loose portion towards the floating unit to move tension from said mooring line upper section and device to said temporary pulling means. The device connected to the mooring line upper section is adapted to slide along the said lower section when pulled by gravity, until the chain locking arrangement locks the said mooring line lower section to the device at a different chain link of the said mooring line lower section.

In a preferred embodiment of the device, the upper mooring line section is a single line connected to the device at an upper connection means and the lower mooring line section is a single line locked to the said device by a chain locking arrangement.

In another preferred embodiment of the device the upper mooring line section comprises two lines connected to the device at respectively two upper connection means and the lower mooring line section is a single line locked to the said device by a chain locking arrangement.

In another preferred embodiment of the device the connection device further comprises a funnel between a funnel entrance and a funnel exit, wherein the funnel entrance is located at the lower end of the device and the funnel exit is located near the upper end of the device, and wherein the lower chain section enters the funnel entrance and the loose end of the mooring line exits the device at the funnel exit.

In another preferred embodiment of the device the chain locking arrangement is located inside the funnel.

In another preferred embodiment of the device a chain guide structure is arranged at the funnel exit, adapted for the loose chain. When said chain is not connected to any pulling means the loose end is resting on the chain guide structure in an area for directional change from being parallel with the funnel inside the said device to the direction of the loose end.

In another preferred embodiment of the device the directional change of the loose chain, when not connected to any pulling means, from being parallel with the funnel inside the said device to the direction of the loose end is at the interlink location between two chain links.

In another preferred embodiment of the device, the temporary pulling means is an auxiliary line temporarily connecting the said lower section of the mooring line to an external pulling device.

In another preferred embodiment of the device the external pulling device is a surface vessel pulling on the pulling means via at least one sheave arrangement on the floating unit.

In another preferred embodiment of the invention the external pulling device is a surface vessel moored to the floating unit via a temporary line and connected to the temporary pulling means and using a winch to pull on said pulling means.

In another preferred embodiment of the invention the external pulling device is a permanent or temporary winch on the floating unit and where the pulling means is either routed via permanent or temporary sheaves on said floating unit or directly to the winch without being routed via any sheaves.

In another preferred embodiment of the invention connection mean is included for attaching a temporary weight element to the device, and where the said temporary weight element is attached to increase the effective weight of the said device.

Another aspect of the invention is a method for an adjustment operation to increase tension in a two-section mooring line with a connecting device as disclosed above, the method comprising the following steps:

a) attaching a temporary pulling means to the loose end and pulling with the temporary pulling means whereby moving tension from the upper mooring line section to said pulling means,
b) unlocking said locking element,
c) moving the said device down the lower section of the mooring line,
d) re-engaging said locking element at a new mooring line length,
e) moving tension back from said temporary pulling means to the upper mooring line section by slackening said temporary pulling means, and
f) removing said temporary pulling means.

The above method may preferably comprise an additional step before unlocking step b): connecting a weight element to the device for aiding in moving the device.

Another aspect of the invention is a method for an adjustment operation to decrease tension in a two-section mooring line with a connection device as disclosed above, the method comprising the following steps:

a) attaching a temporary pulling means to the loose end,
b) pull on loose end with the temporary pulling means until the tension in the lower section is fully transferred from the said locking element to the temporary pulling means,
c) unlock said locking element with an external device and keep open,
d) pay out on the temporary pulling means and feed the lower section through the device,
e) re-engaging said locking element with the external device at a new mooring line length,
f) removing said temporary pulling means.

BRIEF DESCRIPTION OF THE FIGURES

Below, various embodiments of the invention will be described with reference to the figures, in which like numerals in different figures describes the same features.

DETAILED DESCRIPTION OF PREFERRED EMBODIMENTS

The present invention is a device which can be used for both the final connection point during the offshore installation campaign as well as for adjusting the line length (and thus pretension) as part of the installation campaign or at a later stage. This device is located mid-line, i.e. a mooring line segment of chain, steel wire rope or synthetic rope will be connected to the end of the device pointing upwards (typically towards the moored unit), while a chain segment will be connected to the end of the device pointing downwards (typically towards the mooring anchor).

Figure 1:
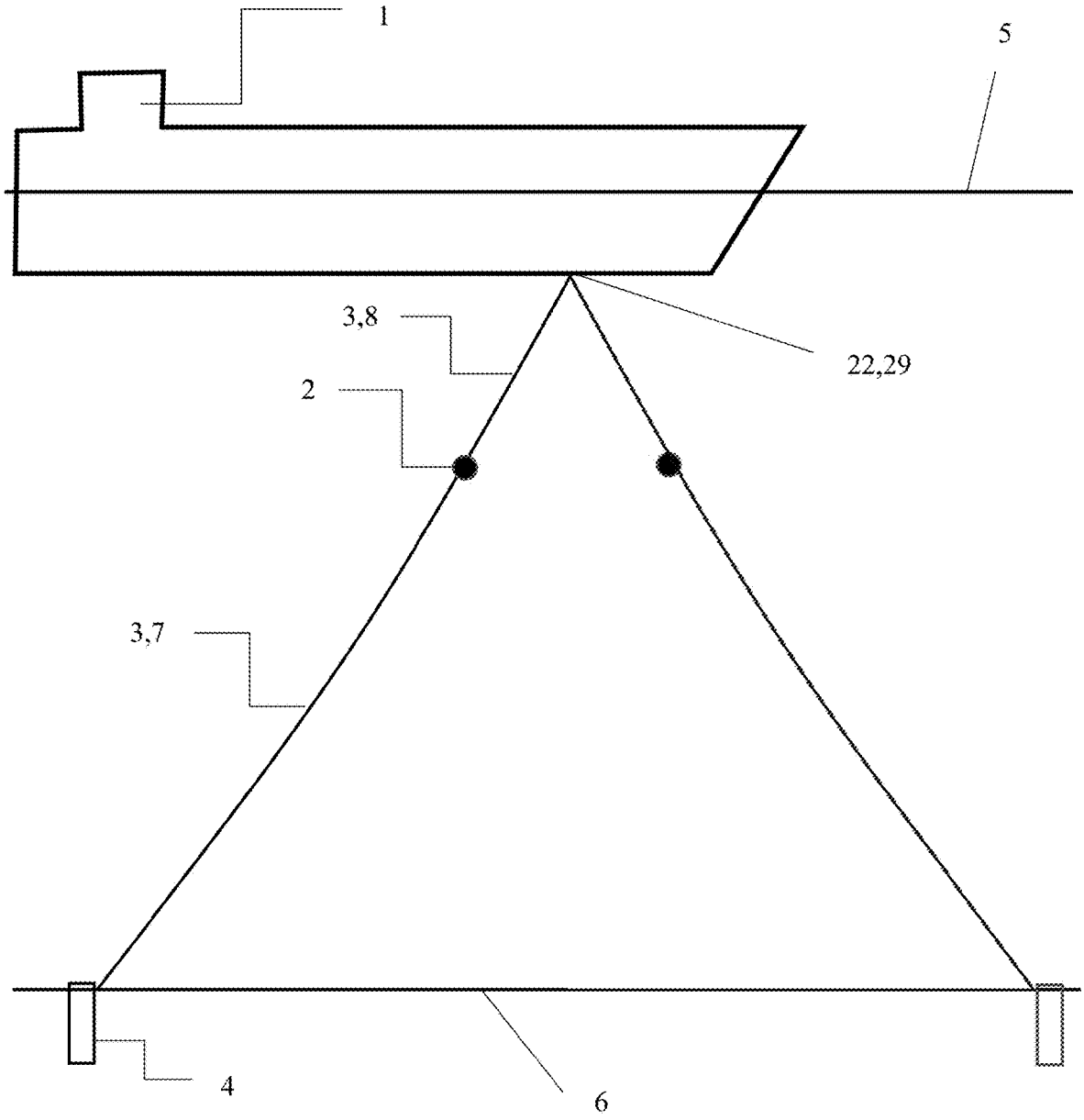
FIG. 1 shows a generic arrangement of a turret-moored vessel.

FIG. 1 shows a moored floating vessel 1 with a turret 22 for weather-vaning capability. The turret is further connected via connection means 29 on the turret and further via mooring lines 3 to anchors 4 on the seabed 6. In this arrangement a mooring line connector and tensioning device 2 is located between an upper mooring line section 8 and a lower mooring line section 7. In another embodiment the vessel 1 floating on the sea surface 5 is spread-moored, in which the vessel does not weathervane. However, also in this embodiment the mooring line connector and tensioning device 2 is for the present invention considered to be located mid-line, and not at either ends of the mooring line 3.

Figure 2:
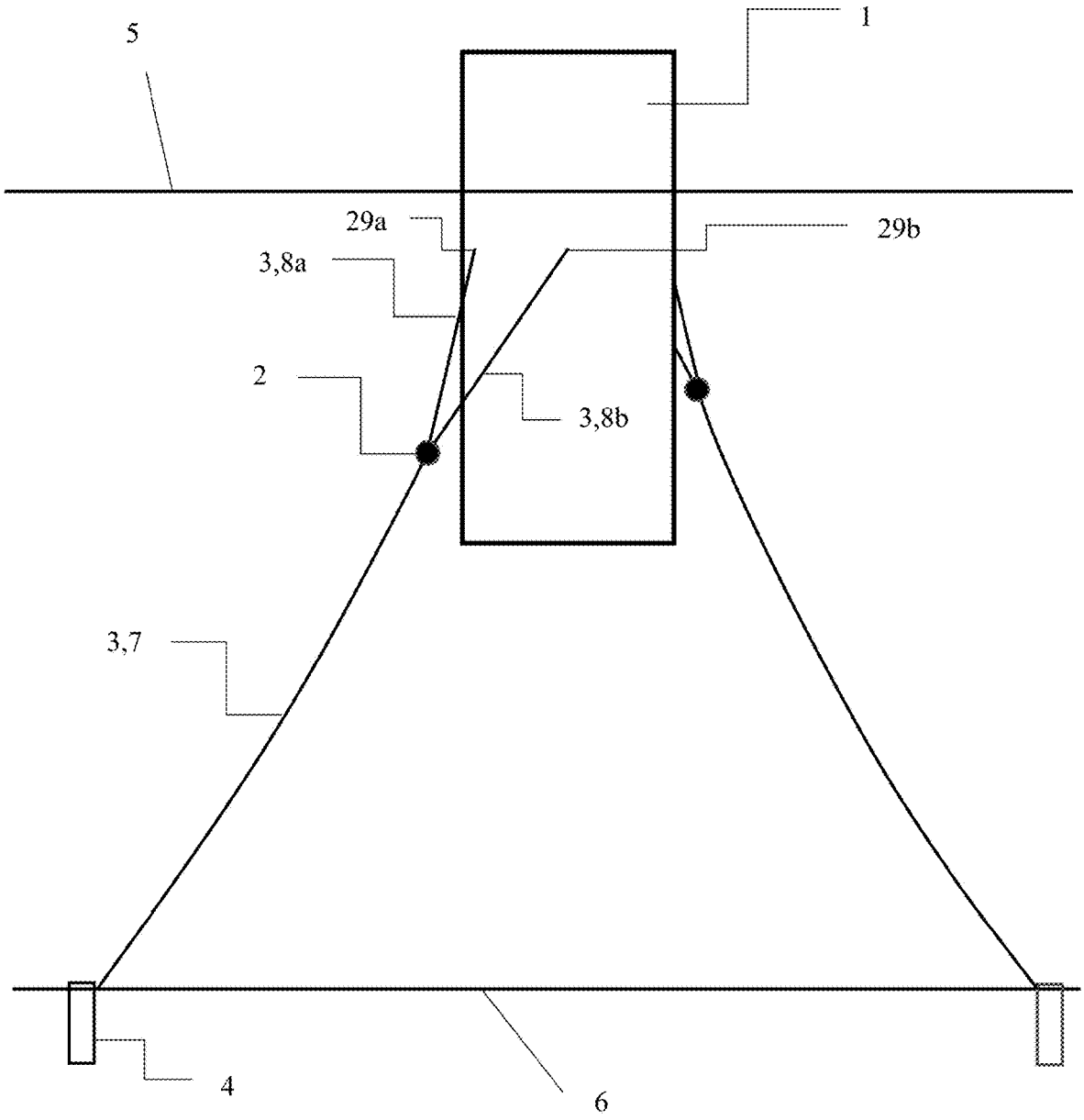
FIG. 2 shows a generic arrangement of a spread-moored unit, where each mooring line has a bridle arrangement towards the unit.

FIG. 2 shows an example of a spread-moored floating unit 1, in which mooring line 3 is split into two sections towards the floating unit, i.e. the mooring line has a single connection to the anchor 4 and a dual or bridle connection towards the floating vessel. In this arrangement the mooring line connector and tensioning device 2 is located at the intersection between the single line 7 towards the anchor and the bridle lines 8*a*,8*b* towards the connection means 29*a*,29*b* on the floating vessel.

Figure 3A:
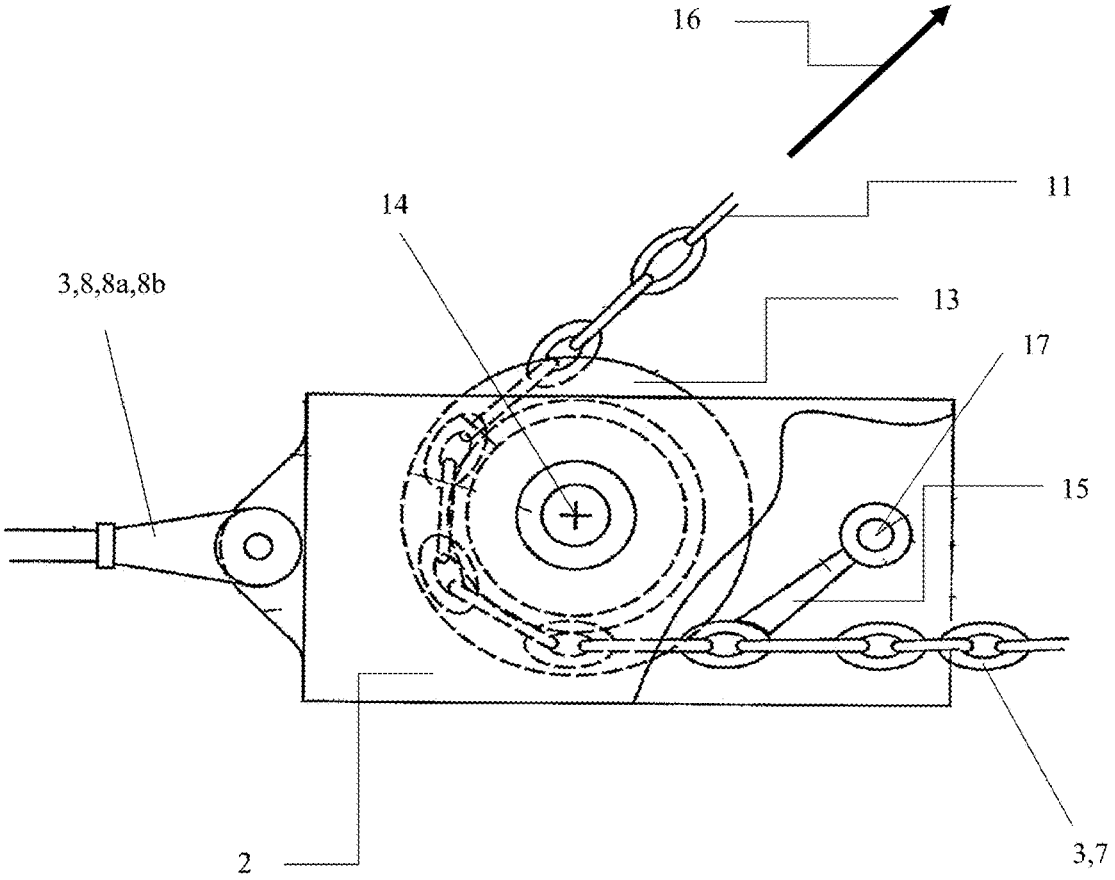
FIG. 3 shows a generic arrangement of a mooring line connector and tensioner with sheave.
Figure 3B:
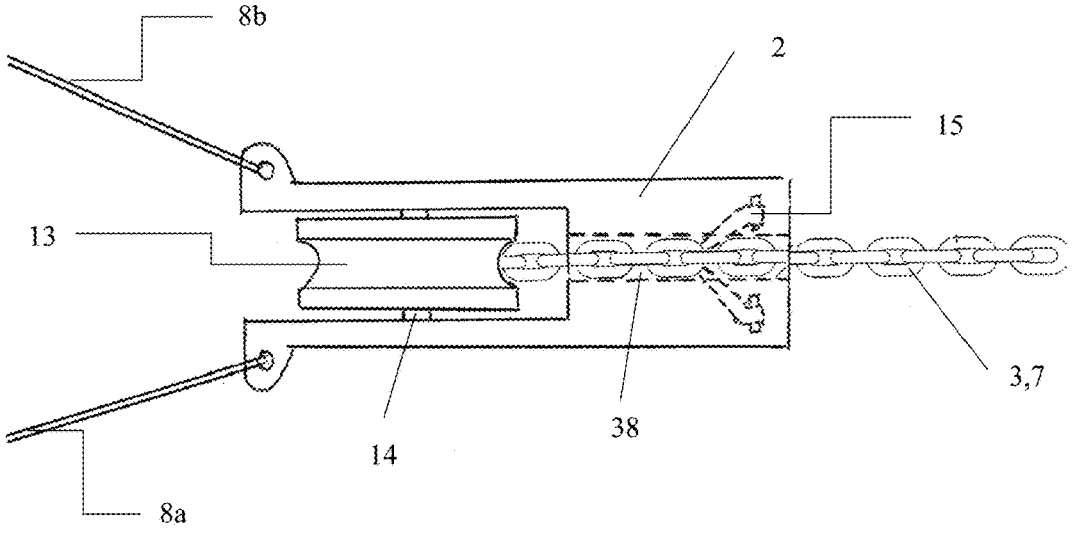

FIG. 3 shows a typical mooring connector and tensioning device 2. In this example the device 2 has a fixed connection to the upper section of the mooring line 3, which can be a single line 8 as illustrated in FIG. 1 or a dual line 8*a*,8*b* as illustrated in FIG. 2. The other end of the device is connected to the lower section 7 of the mooring line 3, which comprises a chain segment at the end towards the device 2. The chain is locked to the device via a chain stopper arrangement 15 with a hinge 17, in which the chain stopper is of a self-latching type, i.e. it stops the chain from being separated from the device but does not prevent the chain from being pulled into and through the device. The chain is locked to the device inside a funnel 38 of the device. The loose end 11 of the chain can be pulled over a sheave 13 with an axel of rotation 14. During the tensioning of the mooring line the loose end 11 is pulled in a direction 16, which is such that the chain 11 is effectively turned more than 90 degrees over the sheave 13, as illustrated in FIG. 3*a*. After the completion of the pull and tensioning operation the pick-up line/pull-line connected to the end of the loose chain section 11 is disconnected from the chain and the loose end 11 of the chain will then hang freely down from the device 2. In one embodiment the loose end 11 will be dropped through an opening in the device between the connection point for mooring line section 8 and the sheave 13. This opening will typically be encapsulated on all four sides, especially if both the lower part of line 3 and the upper part of line 3 are single lines. In this embodiment a future tensioning operation requires that the pick-up line/pull-line is dropped through the same opening in the device before it can be connected to the loose end 11, followed by a lifting operation where the loose end 11 is pulled through the same opening by the pick-up line before the actual tensioning operation commence. In another embodiment the loose end 11 will be dropped to the side and on the outside of the device 2, but in this scenario the weight of the free-hanging chain 11 will turn the device 2 upside down and thus introduce a 180 deg twist in both lower mooring line section 7 and upper mooring line section 8. In an embodiment where the upper part of mooring line 3 is divided into two sections 8*a*,8*b* the device 2 can be designed such that the wheel 13 is encapsulated by three sides only, confer FIG. 3*b*. In this embodiment the loose end 11 and the attached pick-up line/pull-line do not have to be dropped or pulled through any opening enclosed by four sides, and the operation and stability of the connector will then be simpler. For a device 2 with a sheave 13 as illustrated in FIG. 3 the most optimum location of the sheave is at the lower end of the device, because it is easier to obtain a turn over the sheave larger than 90 degrees during tensioning, because it can be obtained by pulling the loose chain end 11 vertically with a winch onboard a surface vessel located vertically above the device. However, this cannot be combined with the mooring arrangement shown in FIG. 2 where the upper part of the mooring line 3 is split into two lines 8*a*,8*b*.

A main objective of the present invention is to simply the design by removing the sheave 13 and associated components. The sheave and the associated components adds cost, complexity, weight and potentially also increases maintenance requirements to the device compared to a device without a permanent sheave arrangement.

Figure 4:
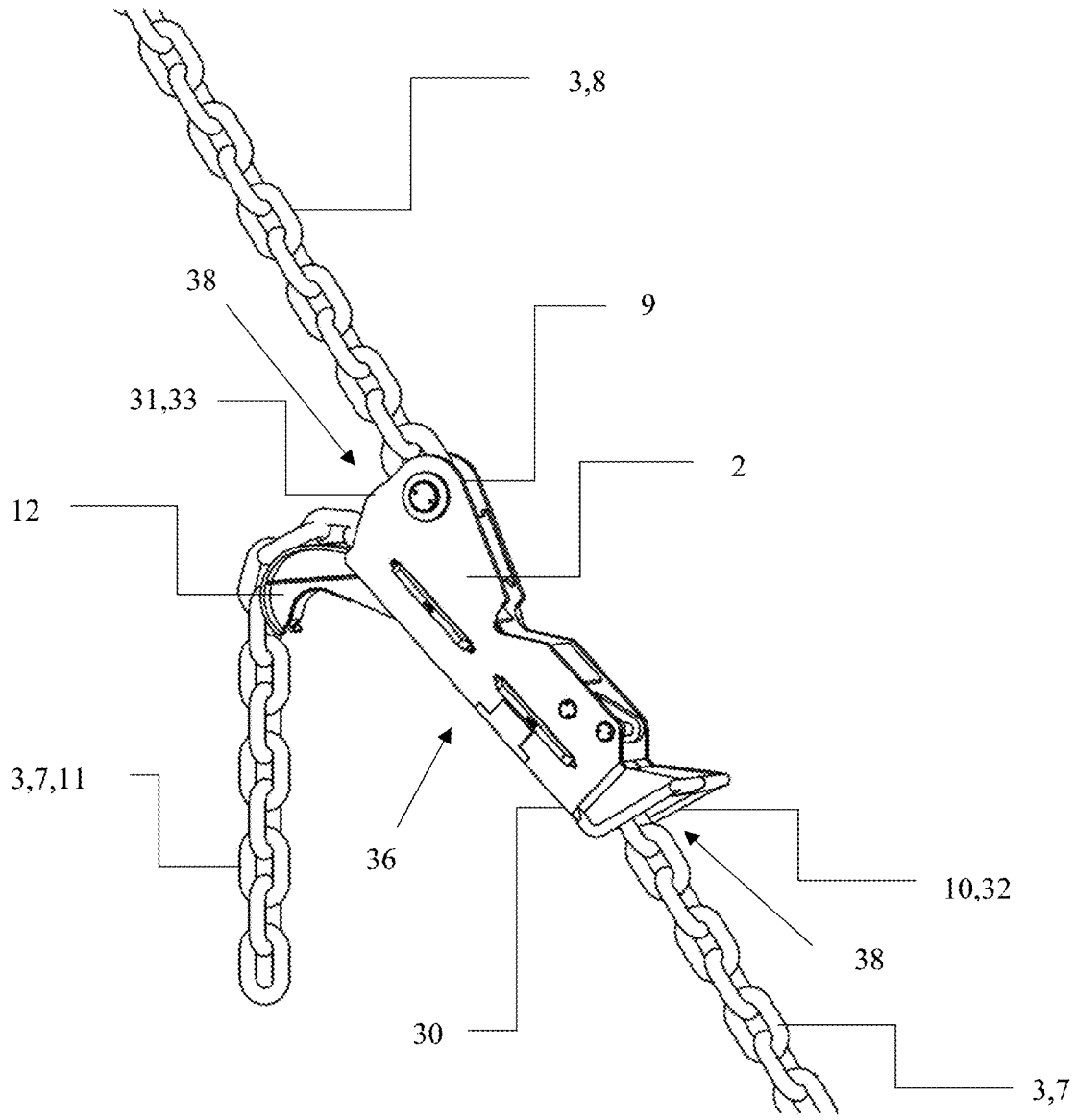
FIG. 4 shows a typical general arrangement of the invention, in which the mooring line has single connection towards the mooring anchor and single connection towards the moored unit.

FIG. 4 shows the combined subsea line connector and tensioning device 2. This device is fixed via connection means 9 to the upper section 8 of the mooring line 3, which is further connected to the floating unit 1 via connections 29. The other end of the device is connected to the lower section 7 of the mooring line 3, which comprises a chain segment at the end towards the device 2. The segment comprises a loose end 11 and the top end of the mooring line lower section 7 in contact with the device 2. The chain locking arrangement 15—when locking said chain segment to the device—divides the segment into the loose end 11 on the upper side of the locking arrangement 15, and a tensioned part of the lower section 7 of the mooring line 3 below the chain locking arrangement 15. The device then has an inside funnel 38, between the entrance 10 at the lower end 32 of the device to an exit 31 at the upper end 33 close to connection 9, in which the upper part of the lower section 7 of mooring line 3 is running through. The upper part of the lower section 7 is chain, which in normal mode is locked inside the funnel by a chain stopper arrangement 15. The chain stopper arrangement is self-latching, i.e. it locks the chain automatically from separating from the device 2, but it opens automatically when the chain is pulled through the device towards the moored unit. In normal mode the chain of lower section 7 is locked permanently to the device by the chain stopper arrangement 15, and the upper end of the lower section 7, i.e. the free/loose end 11 is free-hanging from the device by its own weight over a guide structure 12.

In preparation for connecting lower section 7 of the mooring line 3 to the device 2, which is further connected to the moored unit 1 via the upper mooring line section 8, a pick-up line/pull-line 19 is dropped through the funnel 38 from the exit point 31 close to connection 9 via the funnel and out at the entrance 10. The lower end of the pull-line, i.e. the end dropped through the funnel, is then connected to the upper end of the lower mooring line section 7. The upper end of the pull-line 19 is further connected to a pull system that pulls the pull-line and the lower line section 7 towards the moored unit 1, and thus pulls the upper part of lower section 7 into and through the funnel 38 of the device. The chain stopper arrangement then typically locks the chain for every second link that passes the stopper. The chain stopper will self-latch into closed position such that when the tension in the pull-line 19 is relieved the stopper will hold the chain and prevent it from separating from the device.

The device 2 is kept in position during this operation mainly by gravity, i.e. it is the weight of the device that assures the sliding of the device along the upper part of the lower section 7 when the lower mooring line section 7 is tightened by pulling line 19. If the weight of the device 2 should not be sufficient to overcome friction loads between the device and the chain and overcome the required force to open the chain stopper, then a temporary weight element can be attached to the device to increase the overall weight and thus increase the downward force from gravity. This temporary weight will typically be attached to the device at a connection point 30 on the under-side 36 of the device at a beneficial point along the length axis of the device, in which the length axis direction is defined by a line between the exit point 31 and entrance point 10. To obtain the final target tension for the mooring line 3 the pulling on line 19 is continued and increased until the device 2 has locked a predefined chain link, i.e. the chain link that gives the correct overall mooring line length and thus the correct tension in mooring line 3 after disconnection of pull-line 19.

If the length of mooring line 3 shall be increased and thus the tension in mooring line 3 shall be reduced the same operation as above will in general be conducted, but in opposite order. The locking arrangement 15 can be opened when no load transfer between the locking arrangement 15 and the chain links for the lower section 7 exists. This load transfer is no longer present when the tension in device 2 is transferred to the temporary pulling means 19. When this load transfer has been removed the locking arrangement 15 can be opened. By paying out the temporary pulling means 19 the chain through the device 2 will move in the direction such that the loose end 11, connected to the temporary pulling means 19, gets shorter and the lower section 7 of the mooring line gets longer. However, to pay out the lower section 7 from the device the chain locking arrangement 15 needs to be opened with an external device. The external device can be either a diver, a Remotely Operated Vehicle (ROV) or any suitable tool like a remote operable locking mechanism comprising an actuator and signal receiver. To decrease tension in a two-section mooring line a method according to independent claim 15 is disclosed herein Since the funnel 38 and the connection point 9 are eccentric relative each other, with the funnel located underneath the connection point 9, the device will twist/turn to the side when the chain section 11 is tightened by the pull-line and thereby slackening the upper line section 8. The amount of twist/turn can however be controlled and reduced by (a) adjusting the pull direction of section 11 relative the direction of the upper line section 8, (b) lowering the center of gravity on the device relative the elevation of the funnel and (c) lowering the position of the attachment point 30 for the potential temporary weight element relative the elevation of the funnel. Twisting/turning of the device will however not necessarily affect the functionality of the device.

To obtain the required effect from gravity the location of the device 2 along the mooring line 3 is such that the mooring line in vicinity of the device has an inclination where the upper part of the lower mooring line section 7 has an inclination downwards from the device while the lower part of the upper mooring line section 8 has an inclination upwards from the device. Such inclination is generally obtained when the upper end of the upper mooring line section 8 is connected to a floating unit, the lower end of the lower mooring line section 7 is connected to an anchor 4 on the seabed 6, and the device 2 is not resting on the seabed but located somewhere in the water column. In another embodiment the lower mooring line section is not connected to an anchor on the seabed but connected to another floating unit or another structure with an elevation higher than the elevation of the device 2. In this embodiment the mooring line 3 between the two floating unit must have a section on the line that is deeper than the rest, such that the device 2 can be placed in a section of the line which is located higher in the water column than the deepest point of mooring line 3.

Figure 5:
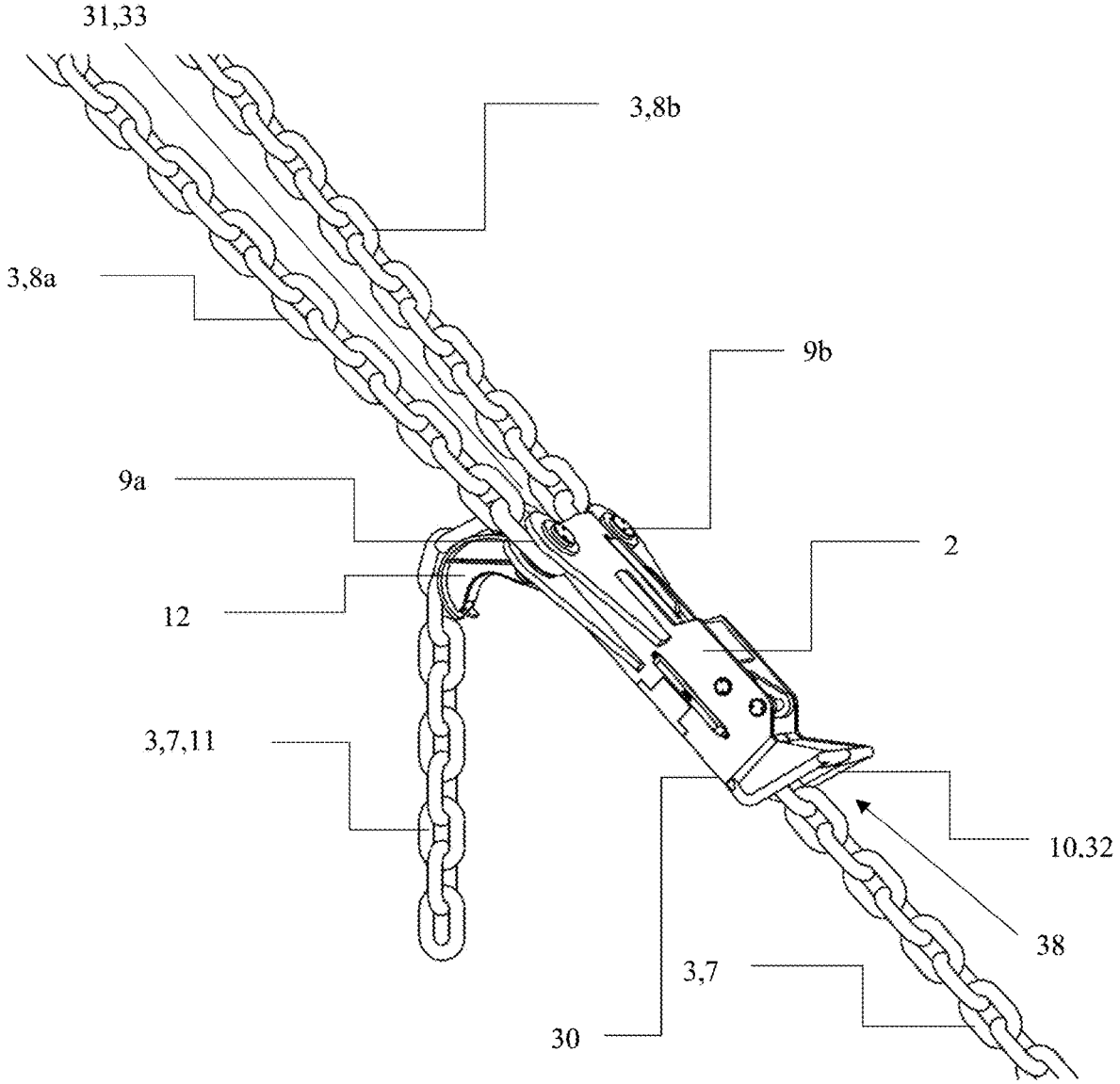
FIG. 5 shows a typical general arrangement of the invention, in which the mooring line has single connection towards the mooring anchor and bridle connection towards the moored unit.

FIG. 5 shows another embodiment of the device 2, in which two lines 8*a*,8*b* are connected to the device at connection points 9*a*,9*b* at one end and to the moored unit 1 at connection points 29*a*,29*b* at the other end. Functionality of this embodiment is the same as for the device shown in FIG. 4. It is however simpler in the way that the elevation of the funnel (in the local coordinate system for the device) and the connection points 9*a*,9*b* can be arranged to be the same, which will be beneficial for the operation of the device. In the horizontal direction of the device the connection points 9*a*,9*b* are on either side of the funnel 38, through which the lower line section 7 passes. In this embodiment the device 2 will not twist/turn during the connection and tensioning process.

Figure 6A:
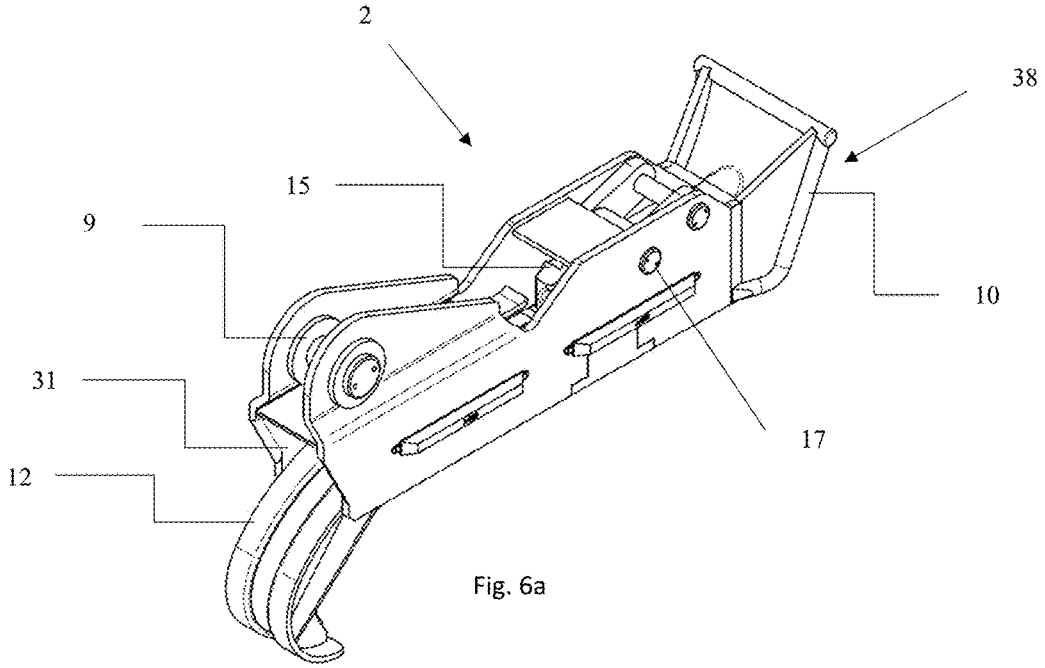
FIG. 6 shows different views of the invention, in which the mooring line has single connection towards the mooring anchor and single connection towards the moored unit.
Figure 6B:
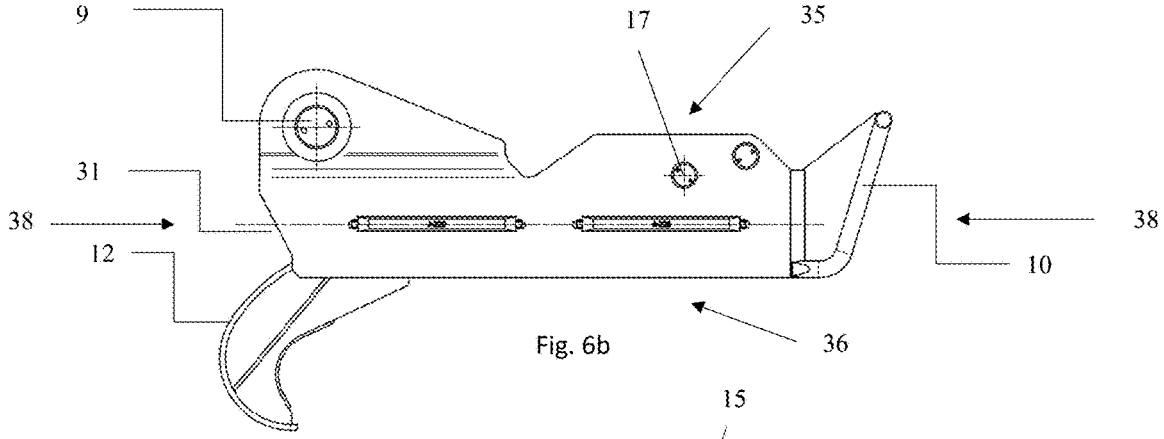
Figure 6C:
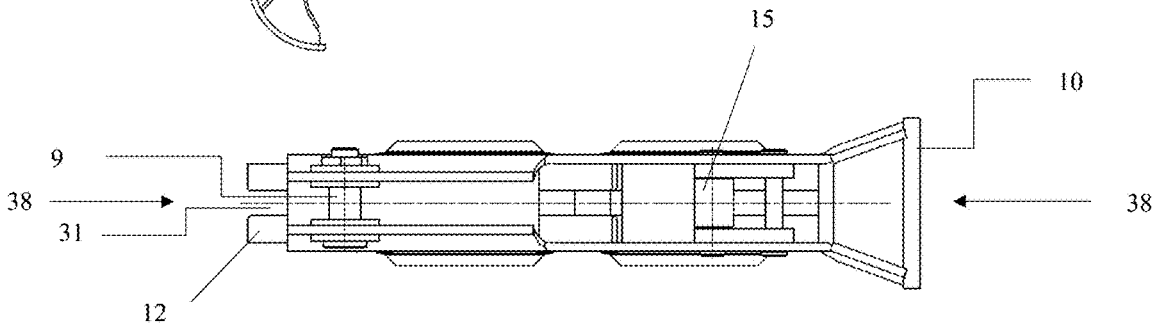

FIG. 6 associates with FIG. 4 and shows different views of device 2. The chain stopper arrangement 15 is shown to be inside the funnel 38. The actual chain stopper element is hinged around pin 17.

Figure 7A:
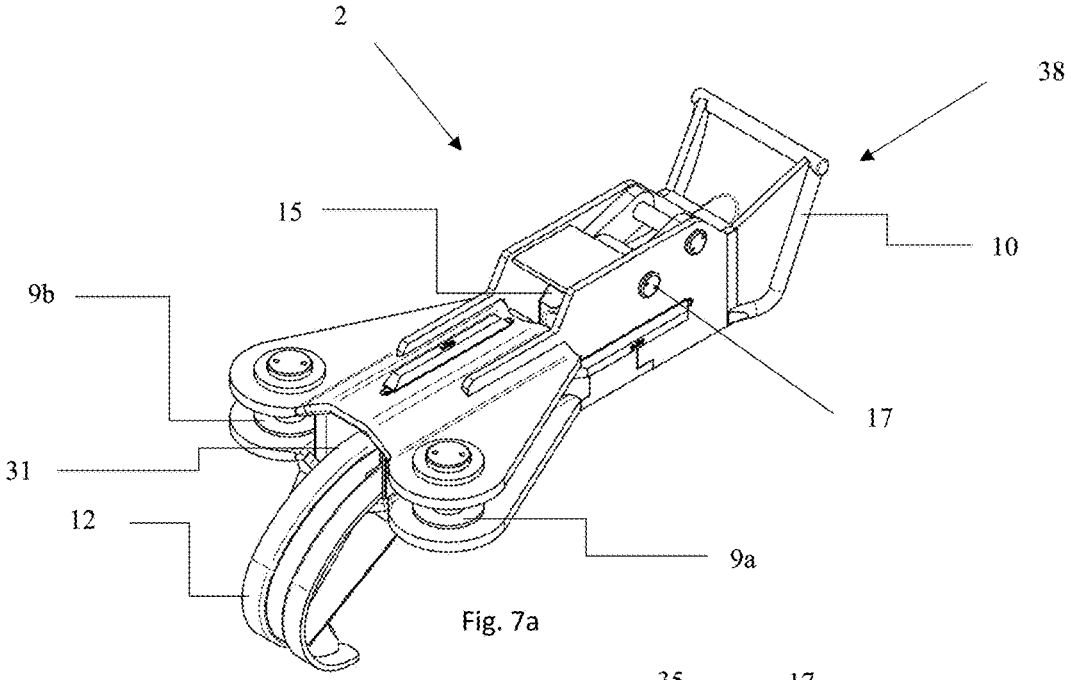
FIG. 7 shows different views of the invention, in which the mooring line has single connection towards the mooring anchor and bridle connection towards the moored unit.
Figure 7B:
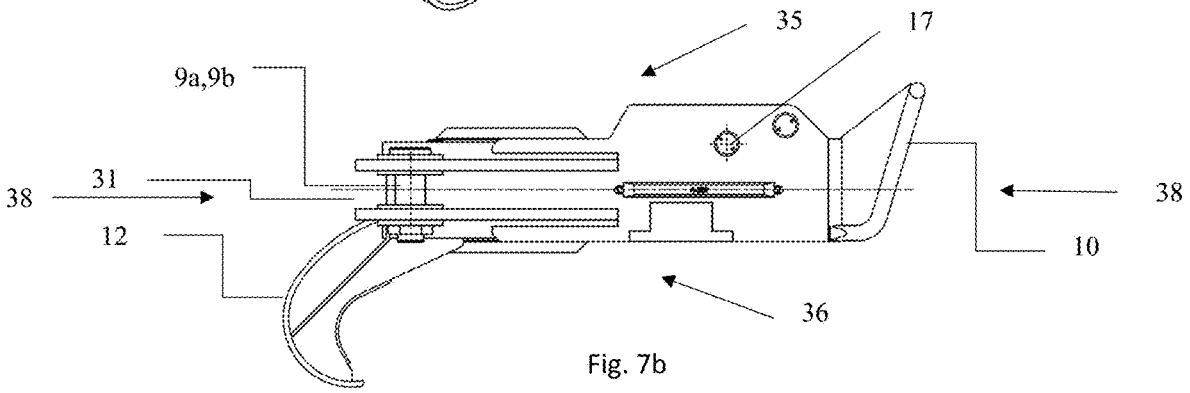
Figure 7C:
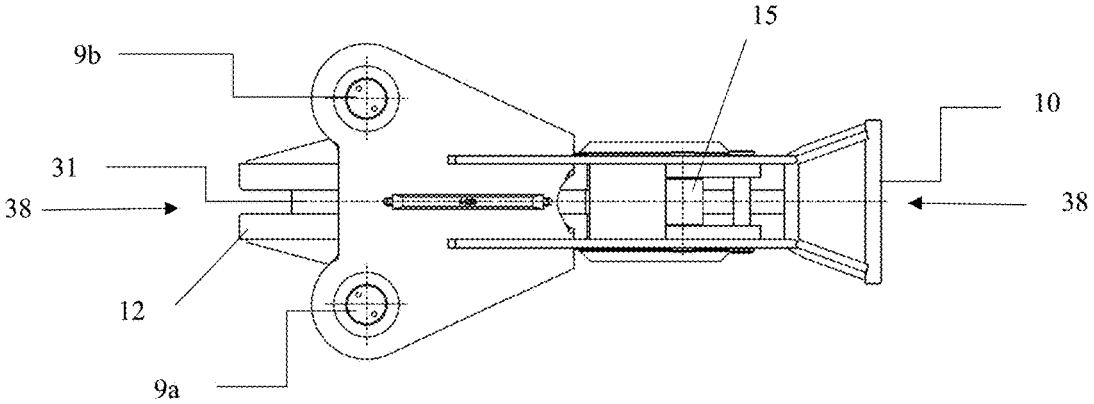

FIG. 7 associates with FIG. 5 and shows different views of device 2. The chain stopper arrangement 15 is shown to be inside the funnel 38. The actual chain stopper element is hinged around pin 17.

Figure 8A:
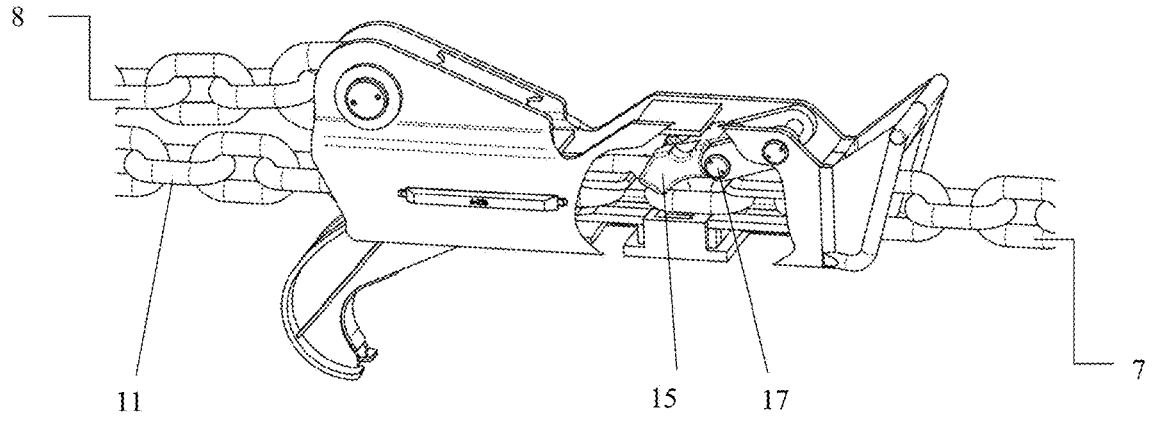
FIG. 8 shows cut-out and section view of the invention, in which the mooring line has single connection towards the mooring anchor and single connection towards the moored unit.
Figure 8B:
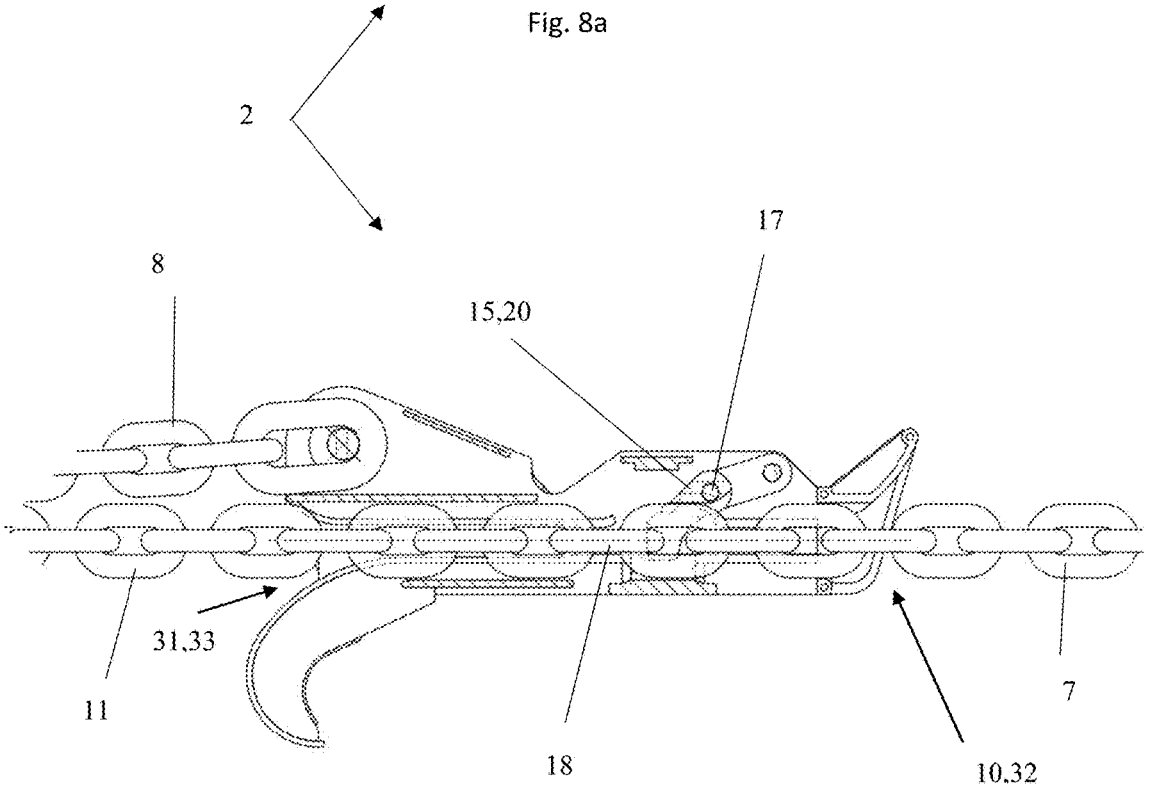
Figure 9D:
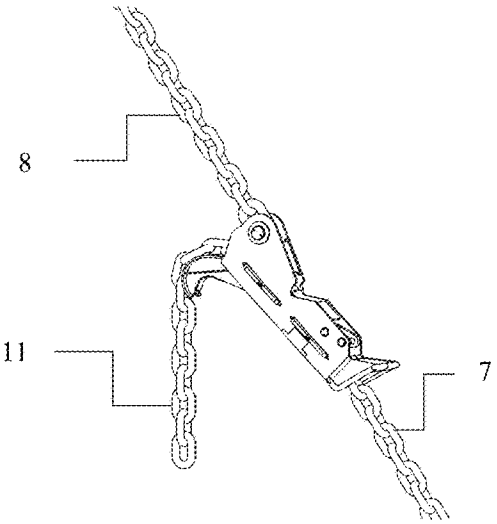
FIG. 9 shows different steps for pull-in and tensioning of the mooring line with the invention, in which the mooring line has single connection towards the mooring anchor and single connection towards the moored unit.
Figure 9C:
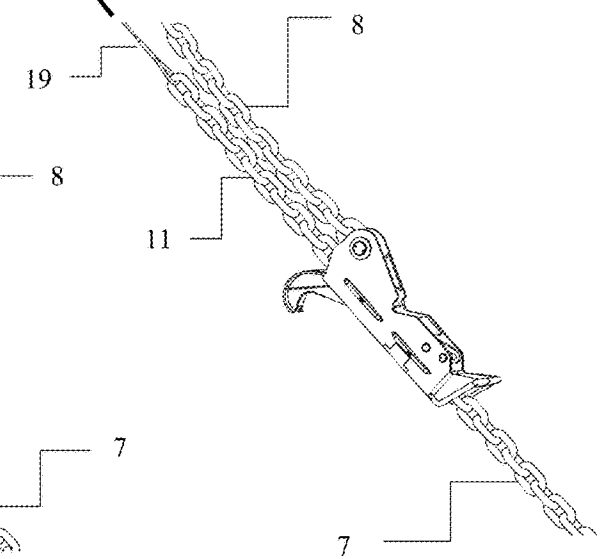
Figure 9B:
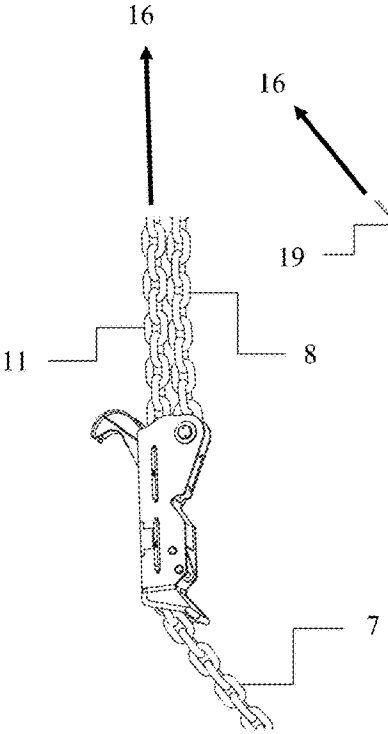
Figure 9A:
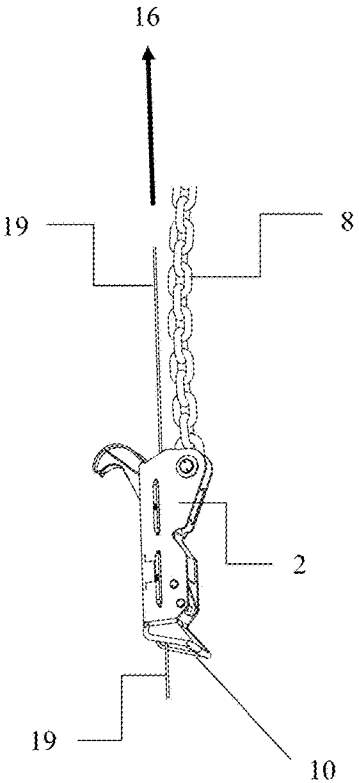

FIG. 8 associates with FIG. 4 and FIG. 6 and shows a cut-out view and a section view of device 2. Both FIG. 8*a* and FIG. 8*b* show the funnel 38, through which the lower line section 7,11 runs. In FIG. 8*b* the chain locking element of the chain stopper arrangement 15 is shown in locked position 20, whereby chain link 18 is locked. In a non-limiting example, the chain stopper arrangement is a ratchet and pawl lock with a pawl 15 for engaging with the chain segment, wherein the pawl 15 is rotably hinged to a pin 17, positioned close to the top of the device. The locking pawl 15 disengages the chain segment when the loose chain portion is pulled towards the floating unit 1 and locks the chain segment when the chain segment is pulled or tensioned in the opposite direction. The closing of the locking element can be by gravity or by spring(s), or a combination thereof. For a person skilled in the art it is obvious that different types of chain stopper designs and arrangements can be applied.

FIG. 9 gives a high-level sequential illustration of the connection and tensioning operation for the device shown in FIG. 4, FIG. 6 and FIG. 8. FIG. 9*a* shows a snapshot after the pull-line has been connected to the lower chain section 7, but before the tension in the pull-line 19 has reached any high level, i.e. the device 2 is hanging straight down due to its own weight. The funnel entrance 10 is designed such that the pull-line will orient the device towards the mooring anchor 4 with the upper-side up and under-side down as soon as the pull-line starts to lift the lower chain section 7 towards the device. In FIG. 9*b* the upper chain end of the lower line section 7 has been pulled into and through the device 2, but tension in the pull-line 19 and section 11 is still relatively low. In FIG. 9*c* the pull tension has been increased such that the pull-line 19, chain 11 and the lower line section 7 forms a catenary shape configuration. In this configuration the device 2 follows and slides along the upper chain part of the lower section 7. In FIG. 9*d* the pull-line 19 has been disconnected from chain 11 and the chain stopper arrangement 15 has locked the lower line section 7 to the device 2. The loose chain 11 is free-hanging from the funnel exit 31 at the upper end 33 of the device via a guide structure 12. In another embodiment the guide structure 12 is removed, confer FIG. 13.

Figures 10A, 10B, 10C, 10D:
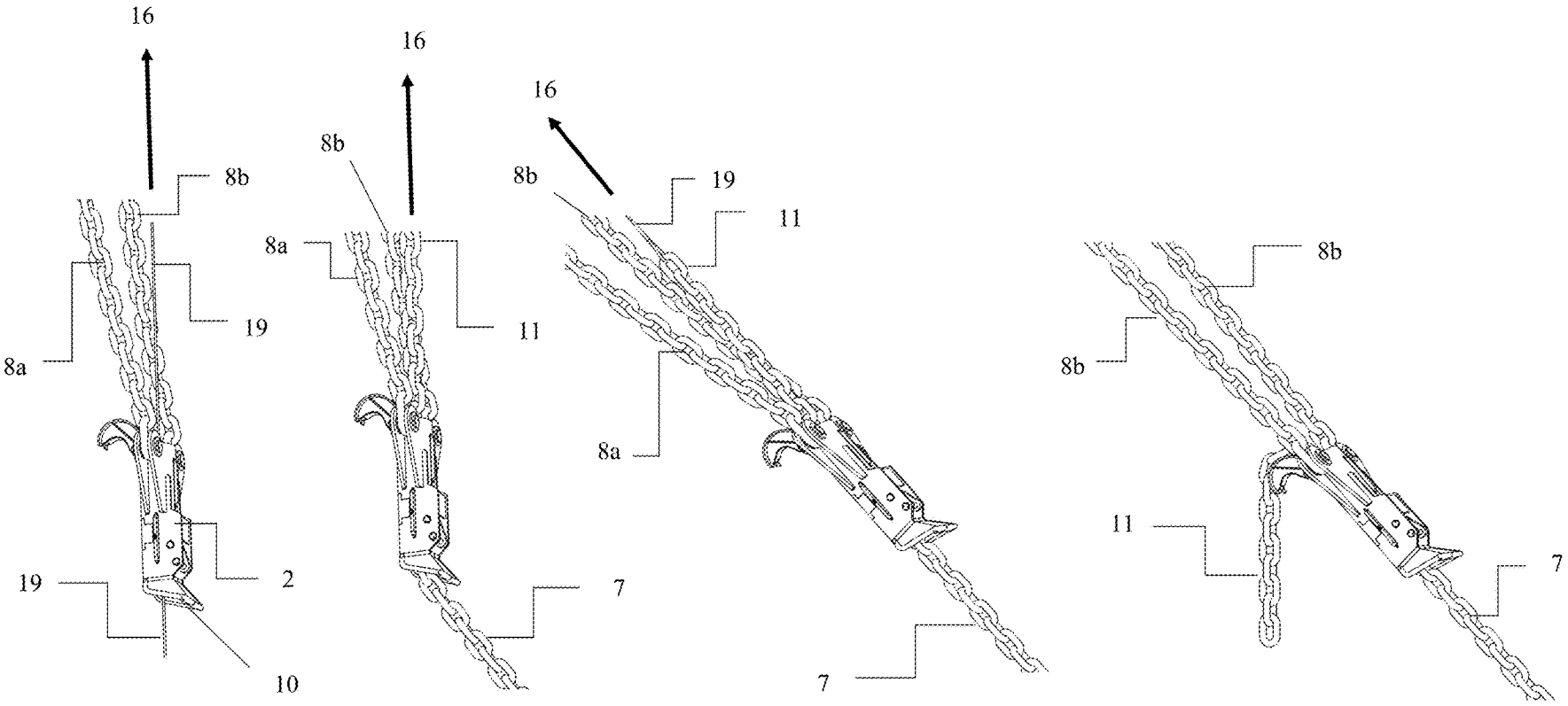
FIG. 10 shows different steps for pull-in and tensioning of the mooring line with the invention, in which the mooring line has single connection towards the mooring anchor and dual connection towards the moored unit.

FIG. 10 gives a similar high-level sequential illustration of the connection and tensioning operation for the device as FIG. 9, but for the device embodiment as shown in FIG. 5 and FIG. 7.

Figure 11C:
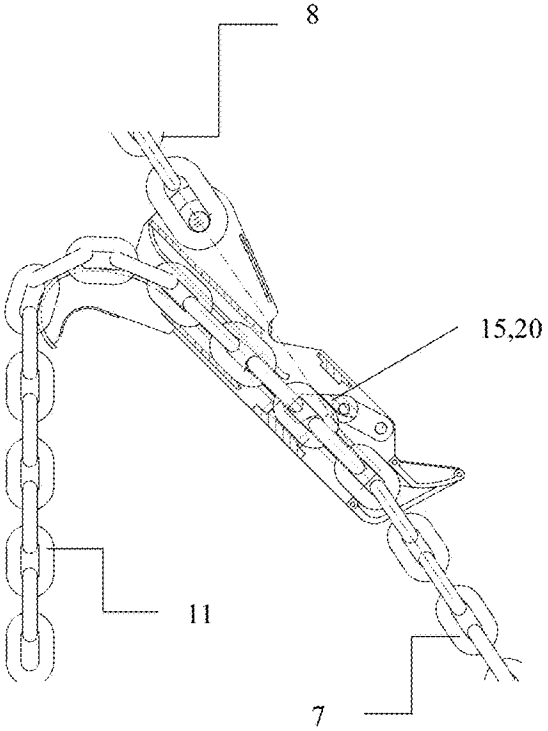
FIG. 11 shows section views for different scenarios during pull-in and tensioning of the mooring line with the invention, in which the mooring line has single connection towards the mooring anchor and single connection towards the moored unit.
Figure 11B:
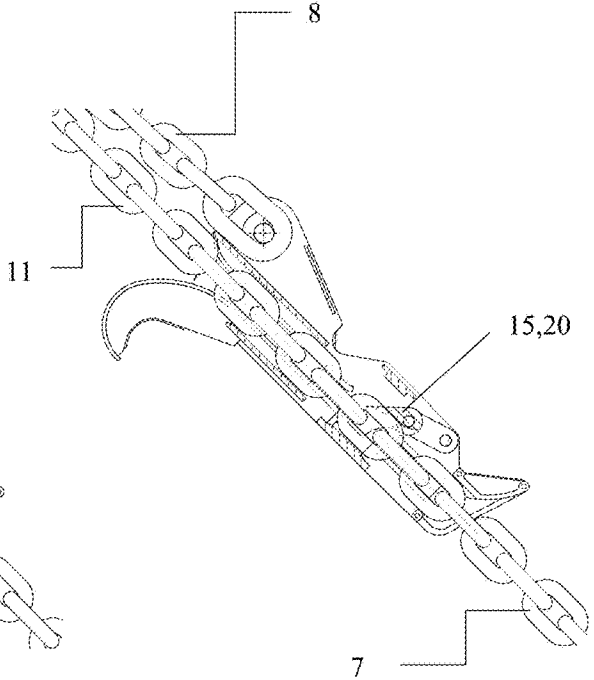
Figure 11A:
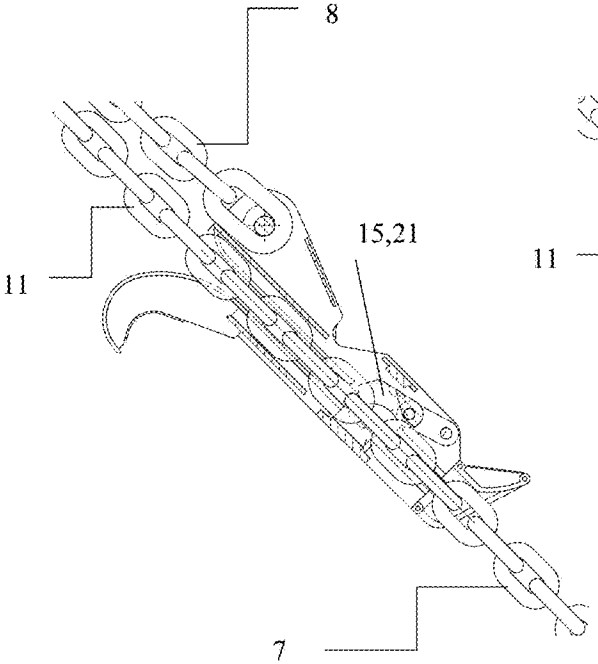

FIG. 11 shows sectional views of the device embodiment according to FIG. 4 for different scenarios of the tensioning operation. In FIG. 11*a* the device is sliding along the chain part of the lower line section 7 and the chain locking element is forced into open position 21. In FIG. 11*b* the chain locking element has moved into locked position 20. FIG. 11*c* shows the chain locking element in locked position and the pull-line 19 disconnected from chain 11, whereby chain 11 is free-hanging from the device.

Figure 12C:
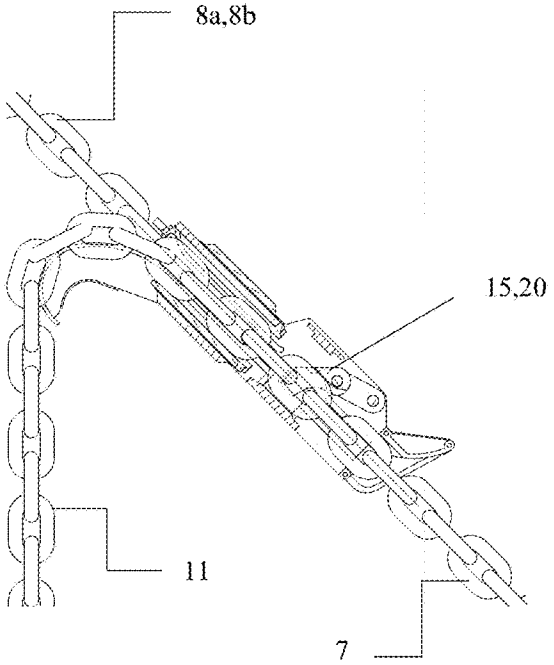
FIG. 12 shows section views for different scenarios during pull-in and tensioning of the mooring line with the invention, in which the mooring line has single connection towards the mooring anchor and dual connection towards the moored unit.
Figure 12B:
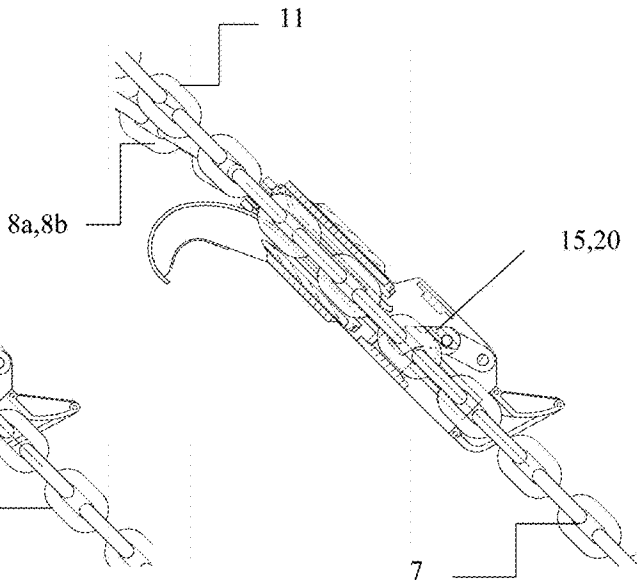
Figure 12A:
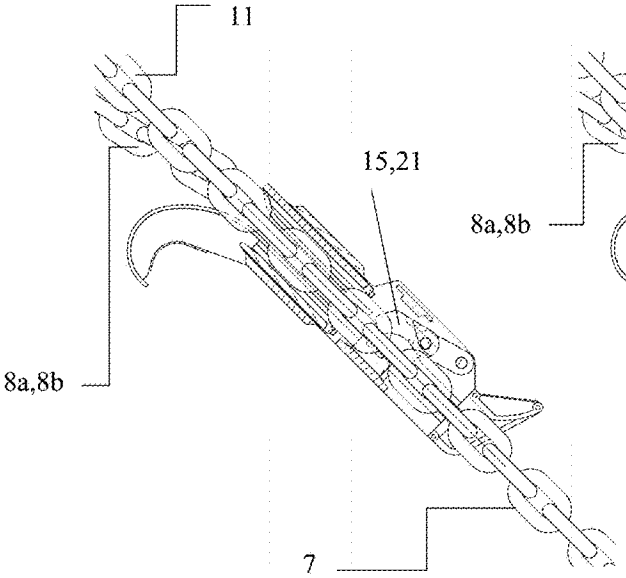

FIG. 12 shows the same as FIG. 11, but for the embodiment with dual lines 8*a*,8*b* towards the moored unit 1. Confer also FIG. 5, FIG. 7 and FIG. 10.

Figure 13A:
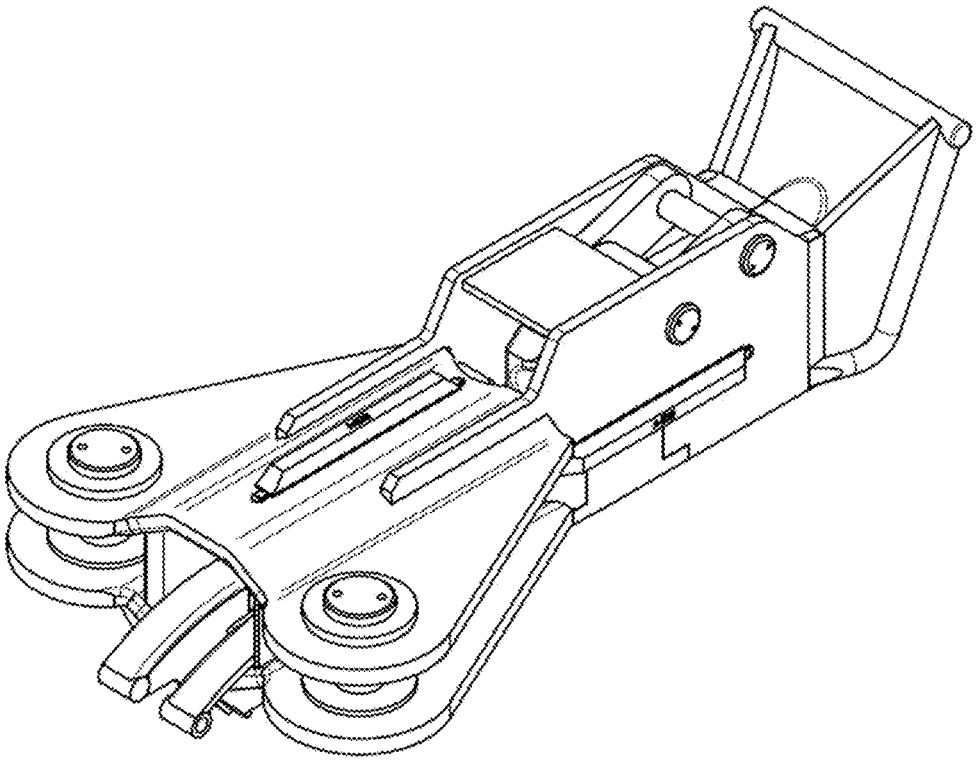
FIG. 13 shows the invention without guide arrangement for loose chain end.
Figure 13B:
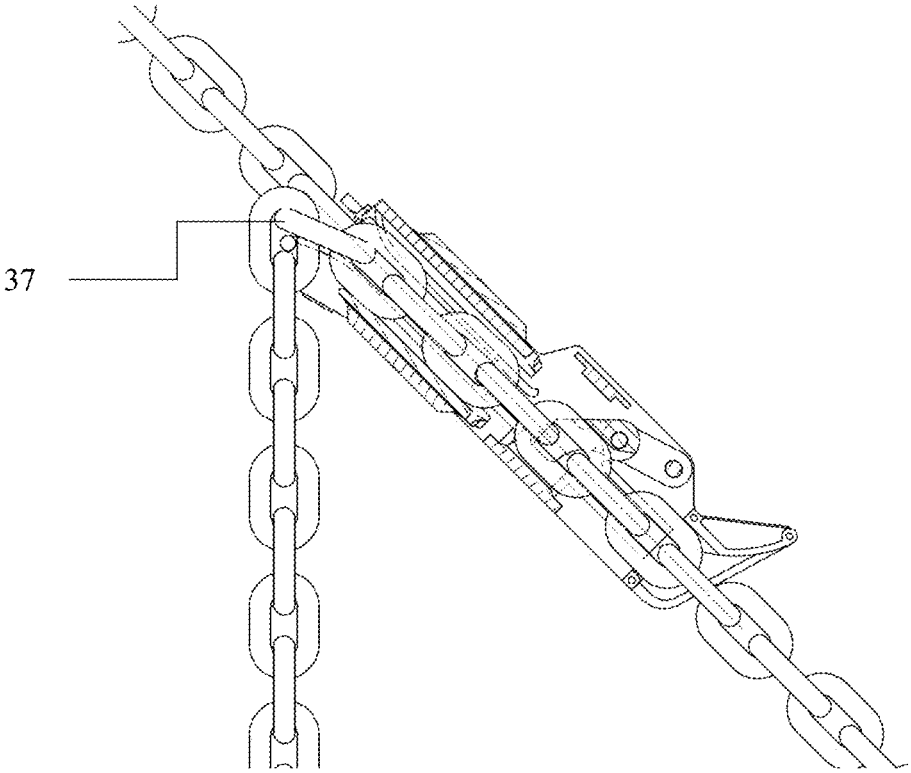

FIG. 13 shows another embodiment, in which the chain guide 12 is removed or reduced to an absolute minimum. In this embodiment, the free hanging chain 11 will not rest on a curved guide structure 12 when the direction of chain 11 changes from a direction corresponding to the direction of the funnel to a direction corresponding to the direction of the gravitational force and other relative directions between the funnel and free-hanging chain end due to dynamic motions. Instead the relative direction between the funnel direction and the direction of the free hanging chain will be taken by the inherent hinge 37 between two chain links—the interlink hinge point—as shown in FIG. 13*b*.

Figure 14A:
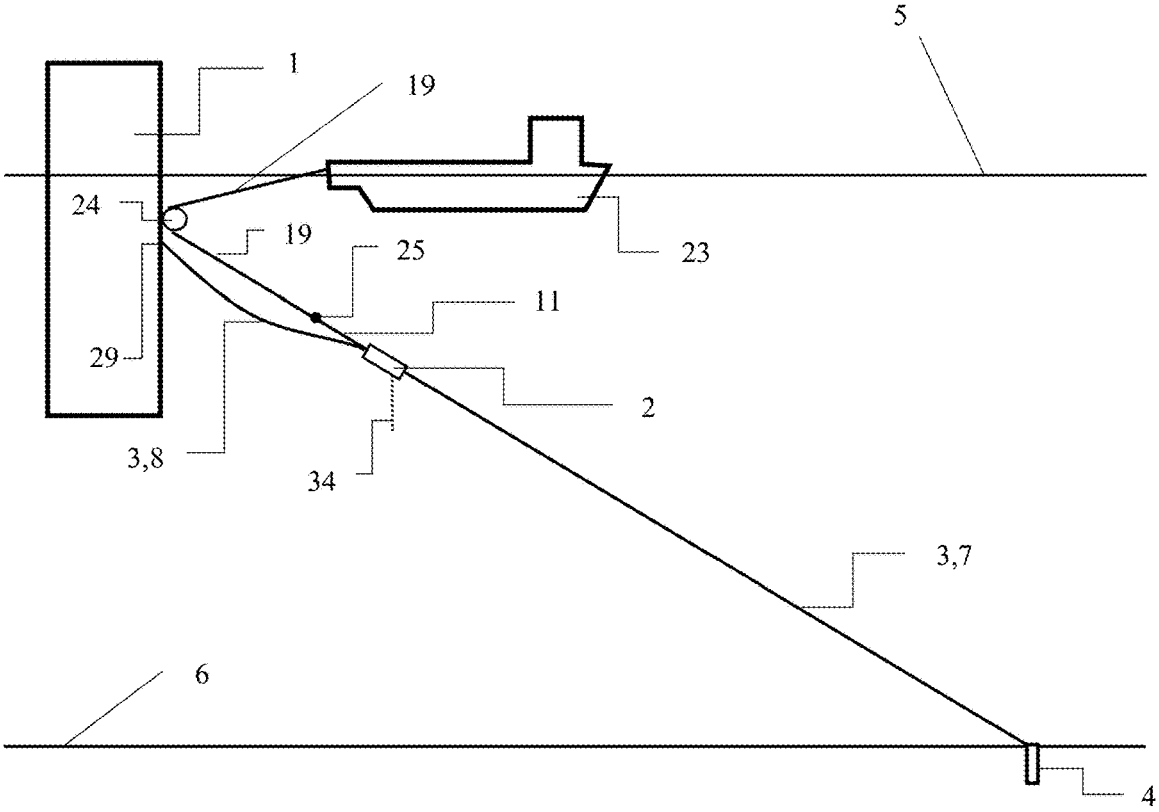
FIG. 14 shows tensioning operation using auxiliary surface vessel.
Figure 14B:
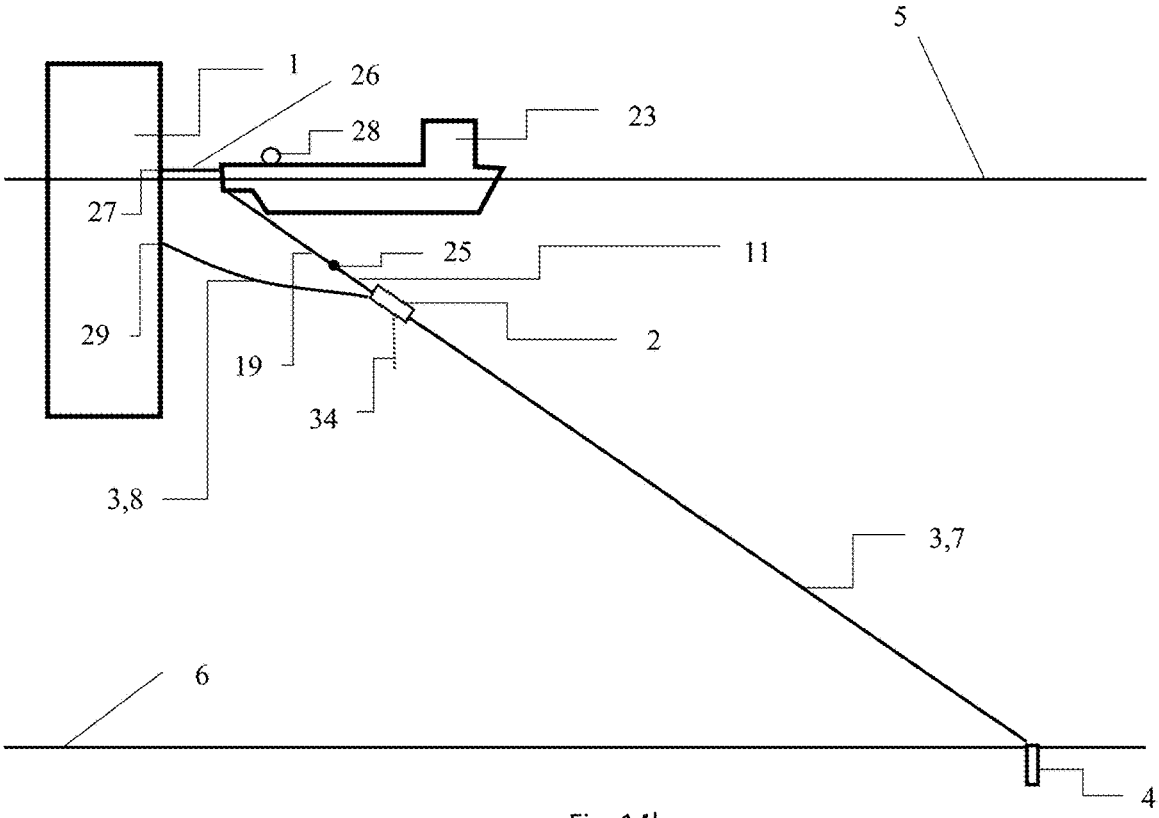

FIG. 14 shows two possible ways to tension mooring line 3 with the help of an auxiliary surface vessel 23. In FIG. 14*a* the vessel 23 needs a bollard pull capacity at or above the target pretension in the mooring line 3. In this embodiment the pull-line 19 is connected to the end of chain section 11 via connection means 25. The pull-line is routed via a sheave arrangement 24 on the moored unit 1 to the vessel 23. This sheave arrangement can be a permanent sheave or a temporary sheave. The vessel then pulls on the pull-line by using thrust. The upper mooring section 8 will then get slack and the connector and tensioning device 2 will then slide downwards along the upper chain part of the lower line section 7. If the weight of the device 2 itself is not sufficient to make it slide along the chain then a temporary weight element 34 can be attached to the device 2 to increase its efficient weight. "Temporary" in the above context means something that is attached and used only for this operation and does not need to be there at other times. FIG. 14*b* shows another embodiment with a surface vessel 23, in which the surface vessel is connected to the moored unit via a hold-back line 26 connected to the moored unit 1 at a connection point 27. The pull-line 19, which is at the lower end is connected to chain section 11 via connection means 25, is then at the upper end connected to a winch 28 on the surface vessel 23. The winch is then used to pull on the pull-line 19 and thereby pull on the lower line section 7. As for the embodiment in FIG. 14*a* the device 2 will then slide along the chain, and thereby effectively shorten the length of mooring line 3.

Figure 15A:
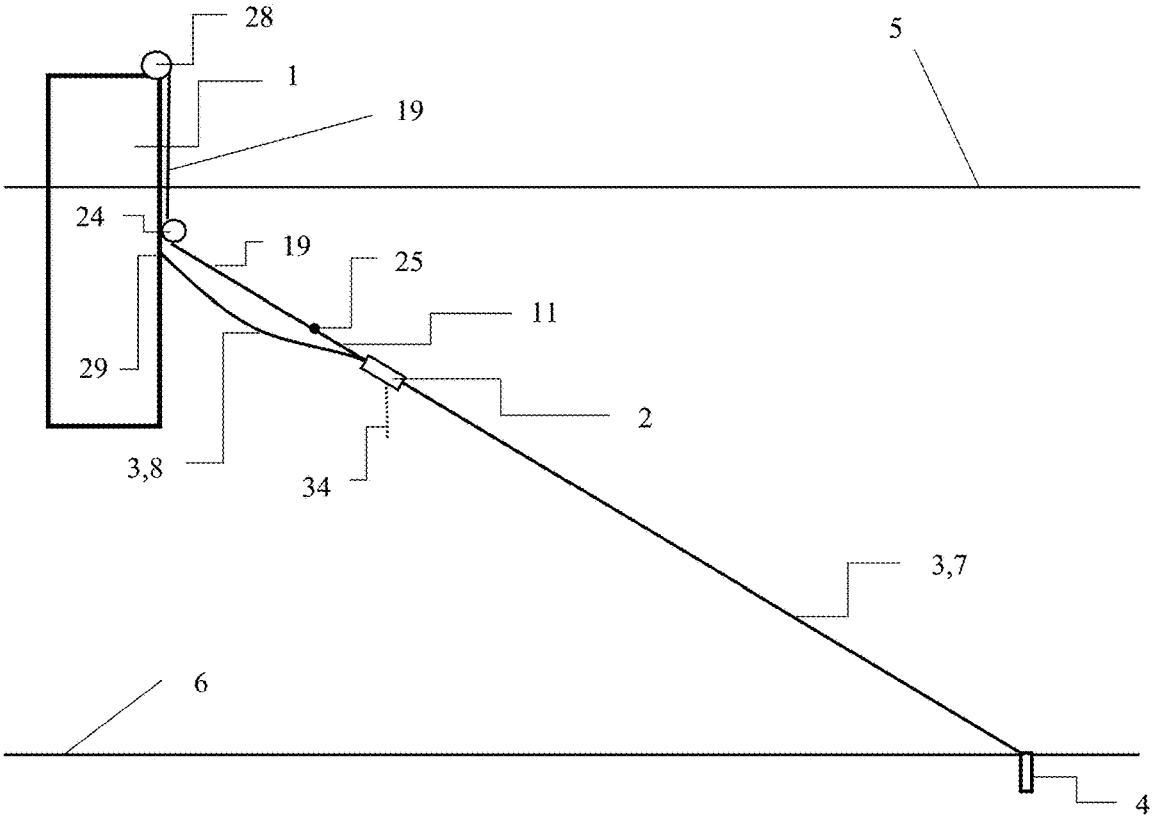
FIG. 15 shows tensioning operation using winch onboard moored unit.
Figure 15B:
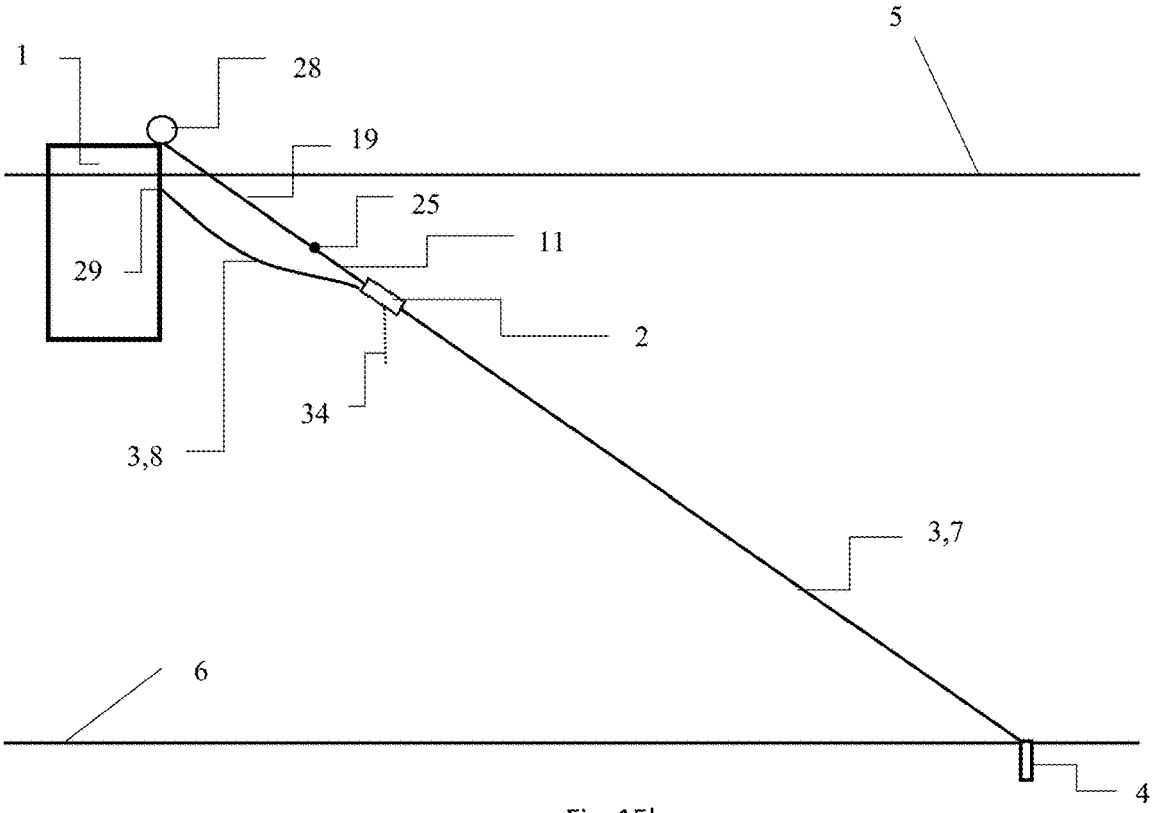

FIG. 15 shows two embodiments, in which a permanent or temporary pulling winch 28 is located on the moored unit 1. In FIG. 15*a* the pull-line 19 is routed between the connection means 25 and the winch 28 via at least one permanent or temporary sheave arrangement 24. In FIG. 15*b* the winch 28 is located much closer to the connection point 29 for the upper mooring line section 8, which means that a sheave arrangement 24 for the pull-line 19 may be omitted.

Although specific embodiments of the invention have been described and illustrated herein, it is recognized that modifications and variations may readily occur to those skilled in the art, and consequently, it is intended that the claims be interpreted to cover such modifications and equivalents.

REFERENCE NUMERALS

1 Moored floating vessel/unit
2 Subsea mooring chain connector/tensioner
3 Mooring line
4 Mooring anchor
5 Sea surface
6 Sea floor
7 Lower mooring section. Part of mooring line between mooring anchor and subsea connector/tensioner
8 Upper mooring section. Part of mooring line between subsea connector/tensioner and moored unit
9 Connection point on subsea connector/tensioner for part of mooring line connected to moored unit
10 Entrance point on subsea connector/tensioner for part of mooring line connected to mooring anchor, i.e. entrance to funnel.
11 Loose end of mooring line part connected to mooring anchor
12 Guide for loose end of mooring line part connected to mooring anchor
13 Sheave
14 Axle of rotation for sheave
15 Chain stopper device
16 Pull direction
17 Axle of rotation for chain stopper device
18 Chain link locked by chain stopper device
19 Pick-up line/pull-line
20 Chain stopper device in locked position
21 Chain stopper device in open position
22 Turret
23 Auxiliary surface vessel with winch and sufficient bollard pull capacity
24 Temporary or permanent sheave for pull-line on moored unit
25 Means for connecting pull-line to upper end of mooring line connected to mooring anchor
26 Hold-back line for auxiliary surface vessel
27 Connection point for hold-back line on moored unit
28 Temporary or permanent winch on moored unit or auxiliary surface vessel
29 Mooring line attachment point to moored unit
30 Potential location for attaching means for connecting temporary weight element for tensioning operation
31 Funnel exit
32 Lower end of connector/tensioner
33 Upper end of connector/tensioner
34 Potential temporary weight element
35 Upper-side of connector/tensioner
36 Under-side of connector/tensioner
37 Interlink hinge point
38 Funnel

The invention claimed is:

1. A connecting device arranged for connecting a lower section and an upper section of a mooring line to respective lower and upper ends of the connecting device and for adjusting a total length of said mooring line from a previous mooring line length to a new mooring line length, wherein an upper end of the mooring line (3) is connected to a floating unit (1), where at least said lower section comprises a chain segment having a top end connected to the connecting device, and the connecting device comprises a locking arrangement comprising a ratchet and pawl lock with a pawl for engaging with the chain segment, wherein the pawl is rotably hinged to a pin to lock said chain segment to the connecting device, the locking arrangement—when locking said chain segment to the connecting device—dividing said chain segment into a tensioned portion and a loose portion, wherein the connecting device further comprises a funnel between a funnel entrance and a funnel exit, wherein the funnel entrance is located at a lower end of the connecting device and the funnel exit is located at an upper end of the connecting device close to a connection point, and wherein the lower section enters the funnel entrance and a loose end of the loose portion exits the connecting device at the funnel exit, and;

wherein the connecting device further comprises a temporary pulling means connected to the loose end of the loose portion adapted for pulling the loose portion towards the floating unit to move tension from said upper section and the connecting device to said temporary pulling means, wherein the connecting device connected to the upper section is adapted to slide along the lower section when pulled by gravity, until the chain locking arrangement locks the lower section to the connecting device at a different chain link of the lower section.

2. The connecting device according to claim 1, wherein the upper section is a single line connected to the connecting device at an upper connection means and the lower section is a single line locked to the connecting device by a chain the locking arrangement.

3. The connecting device according to claim 1, wherein the upper section comprises two lines connected to the connecting device at respectively two upper connection means and the lower section is a single line locked to the connecting device by the locking arrangement.

4. The connecting device according to claim 1, wherein the locking arrangement is located inside the funnel.

5. The connecting device according to claim 1, wherein a chain guide structure is arranged at the funnel exit, adapted for the loose portion, when not connected to any pulling means, the loose end is resting on the chain guide structure in an area for a directional change from being parallel with the funnel inside the connecting device to a direction of the loose end.

6. The connecting device according to claim 1, wherein a directional change of the loose portion, when not connected to any pulling means, from being parallel with the funnel inside the connecting device to a direction of the loose end is at an interlink location between two chain links.

7. The connecting device according to claim 1, wherein said temporary pulling means (19) is an auxiliary line temporarily connecting the lower section to an external pulling device.

8. The connecting device according to claim 7, where the external pulling device is a surface vessel pulling on the pulling means via at least one sheave arrangement on the floating unit.

9. The connecting device according to claim 7, where the external pulling device is a surface vessel moored to the floating unit via a temporary line and connected to the temporary pulling means and using a winch to pull on said pulling means.

10. The connecting device according to claim 7, where the external pulling device is a winch on the floating unit and where the pulling means is either routed via sheaves on said floating unit or directly to the winch without being routed via any sheaves.

11. The connecting device according to claim 1, where a connection means is included for attaching a temporary weight element to the connecting device, and where the temporary weight element is attached to increase an effective weight of the connecting device.

12. A method for an adjustment operation to increase tension in a two-section mooring line with a connecting device according to claim 1, the method comprising:

a) attaching a temporary pulling means to the loose end and pulling with the temporary pulling means and moving tension from the upper section to said pulling means, b) unlocking said locking arrangement, c) moving the connecting device down the lower section, d) re-engaging said locking arrangement at a new mooring line length, e) moving tension back from said temporary pulling means to the upper section by slackening said temporary pulling means, and f) removing said temporary pulling means.

13. A method according to claim 11, comprising before b): connecting a weight element to the connecting device for aiding in moving the connecting device.

14. A method for an adjustment operation to decrease tension in a two-section mooring line with a connecting device according to claim 1, the method comprising:

a) attaching a temporary pulling means to the loose end, b) pulling on the loose end with the temporary pulling means until tension in the lower section is fully transferred from the locking arrangement to the temporary pulling means, c) unlocking said locking arrangement with an external device and keeping the locking arrangement open, d) paying out on the temporary pulling means arrangement and feeding the lower section through the connecting device, e) re-engaging said locking arrangement with the external device at a new mooring line length, f) removing said temporary pulling means.

* * * * *